US010240420B2

(12) United States Patent
Arnaly

(10) Patent No.: US 10,240,420 B2
(45) Date of Patent: Mar. 26, 2019

(54) METHOD FOR RECOVERING TUBULAR STRUCTURES FROM A WELL AND A DOWNHOLE TOOL STRING

(71) Applicant: Qinterra Technologies AS, Stavanger (NO)

(72) Inventor: Georges Emile Arnaly, Abu Dhabi (AE)

(73) Assignee: Qinterra Technologies AS, Stavanger (NO)

( * ) Notice: Subject to any disclaimer, the term of this patent is extended or adjusted under 35 U.S.C. 154(b) by 0 days.

(21) Appl. No.: 15/536,489

(22) PCT Filed: Dec. 15, 2015

(86) PCT No.: PCT/NO2015/050244
§ 371 (c)(1),
(2) Date: Jun. 15, 2017

(87) PCT Pub. No.: WO2016/099282
PCT Pub. Date: Jun. 23, 2016

(65) Prior Publication Data

US 2017/0328160 A1 Nov. 16, 2017

(30) Foreign Application Priority Data

Dec. 19, 2014 (NO) ..... 20141536

(51) Int. Cl.
*E21B 31/00* (2006.01)
*E21B 29/00* (2006.01)
(Continued)

(52) U.S. Cl.
CPC ..... *E21B 31/00* (2013.01); *E21B 23/01* (2013.01); *E21B 29/00* (2013.01); *E21B 29/002* (2013.01);
(Continued)

(58) Field of Classification Search
CPC ..... E21B 2023/008; E21B 29/002; E21B 29/005; E21B 29/007; E21B 29/02; E21B 31/00; E21B 31/002; E21B 29/00
See application file for complete search history.

(56) References Cited

U.S. PATENT DOCUMENTS 2,261,564 A 5/1940 Robichaux
2,481,637 A 9/1949 Yancey
(Continued)

FOREIGN PATENT DOCUMENTS

WO 2011031164 A1 3/2011

*Primary Examiner* — Robert E Fuller
*Assistant Examiner* — Christopher J Sebesta
(74) *Attorney, Agent, or Firm* — Gable Gotwals

(57) ABSTRACT

This invention relates to a method for recovering a tubular structure (3) from a well (1), wherein a so-called free point is defined as the location where the tubular structure is stuck in the well. The method comprising providing a downhole tool string comprising a pipe-severing tool and an upper part of the downhole tool string; lowering the downhole tool string into the tubular structure to release the free pipe. Before the step of triggering the pipe-severing tool to sever the tubular structure, the method includes releasing the pipe-severing tool and subsequent withdrawing the upper part, of the downhole tool string away from the free point towards the surface over at least a predefined distance. The invention relates to a downhole tool string for use in such method.

8 Claims, 3 Drawing Sheets

(51) Int. Cl.

| | |
|---|---|
| ***E21B 31/16*** | (2006.01) |
| ***E21B 23/01*** | (2006.01) |
| ***E21B 29/02*** | (2006.01) |
| ***E21B 29/08*** | (2006.01) |
| *E21B 23/00* | (2006.01) |

(52) U.S. Cl.
CPC ..... *E21B 29/02* (2013.01); *E21B 29/08* (2013.01); *E21B 31/16* (2013.01); *E21B 2023/008* (2013.01)

(56) References Cited

U.S. PATENT DOCUMENTS

| | | | | |
|---|---|---|---|---|
| 2,746,550 | A | 5/1956 | Milton, Jr. | |
| 4,047,568 | A | 9/1977 | Aulenbacher | |
| 4,619,318 | A * | 10/1986 | Terrell | E21B 29/02 166/212 |
| 5,050,682 | A | 9/1991 | Huber et al. | |
| 5,398,760 | A | 3/1995 | George et al. | |
| 2003/0024702 | A1 | 2/2003 | Gray et al. | |
| 2009/0294127 | A1* | 12/2009 | Krueger | E21B 29/005 166/298 |
| 2010/0258289 | A1* | 10/2010 | Lynde | E21B 23/14 166/55.7 |
| 2012/0199351 | A1 | 8/2012 | Robertson | |
| 2012/0318509 | A1* | 12/2012 | Fuhst | E21B 23/01 166/298 |
| 2014/0231087 | A1 | 8/2014 | Orstad | |
| 2015/0176356 | A1* | 6/2015 | Bakri | E21B 31/20 166/255.1 |

* cited by examiner

METHOD FOR RECOVERING TUBULAR STRUCTURES FROM A WELL AND A DOWNHOLE TOOL STRING

CROSS-REFERENCE TO RELATED APPLICATIONS

This United States application is the National Phase of PCT Application No. PCT/NO2015/050244 filed 15 Dec. 2015, which claims priority to Norwegian Patent Application No. 20141536 filed 19 Dec. 2014, each of which is incorporated herein by reference.

BACKGROUND OF THE INVENTION

The invention relates to a method for recovering a tubular structure from a well, and in particular to a method for recovering a stuck drill pipe from a well, particularly a highly deviated or horizontal well. The invention further relates to a downhole tool for use in such method.

Pipe recovery operations are used in drilling operations in the oil and gas industry, where the drill string can become stuck downhole. Stuck pipe prevents the drill rig from continuing operations. This results in costly downtime, ranging anywhere from several thousands of dollars up to several millions of dollars per day of downtime, therefore it is critical to resolve the problem as quickly as possible. Pipe recovery is the process by which the location of the stuck pipe is identified, and the free pipe is separated from the stuck pipe. This allows fishing tools to subsequently be run down hole to latch onto and remove the stuck pipe.

The term "pipe" is must be interpreted such that it includes a pipe string comprising several pipe segments, which are connected together via so-called pipe joints.

The term free point is used to describe the delineating point between the stuck pipe and the free pipe in a pipe string. Every joint of the pipe above the free point is free, meaning it can rotate freely and be moved in and out of the hole, provided it was not attached to the remaining joints of stuck pipe below the free point.

Various tools for cutting a pipe exist in the prior art.

A first type of cutting tool, being the most traditional type, is the "Drill Collar Severing Tool (DCST)". The Drill Collar Severing Tool is often used to separate heavy weight drill pipe or drill collars. The DCST contains an explosive charge at either end of the tool; both charges are detonated simultaneously. The explosive shock waves meet in the centre of the tool and combine to produce a very high-energy wave capable of cutting through the thickest of types of pipe. The severed pipe is typically split and deformed, requiring milling.

A second type of cutting tool is the "Chemical Cutter". Chemical cutters use a propellant to generate pressure forcing the chemical, usually Bromine Trifluoride, through a catalyst. The resulting chemical reaction is expelled through the severing head of the cutter at a high temperature and pressure, which cuts the wall of the tubing. The resulting cut is a very smooth cut that does not require any dressing before further pipe recovery operations can take place.

A third type of cutting tool is the "Jet Cutter". Jet cutters use a circular-shaped charge to produce the cutting action. Jet cutters are capable of severing pipe despite significant downhole pressure. This makes them an ideal choice for extremely deep wells, greater than 20,000 feet deep. They typically leave a flare on the severed pipe string. This flare must be removed, typically by using a mill, before further pipe recovery operations can take place.

A fourth type of cutting tool is the "Radial Cutting Torch (RCT)". Radial cutting torches use a mixture of powdered metals contained inside the torch body, those metals burn at a very high temperature on ignition by a gas generator. The resultant molten plasma is then ejected through a radial graphic ceramic nozzle and onto the target tubing. The result is a clean, non-flared cut. The highly energized plasma is capable of over-coming nearly any wellbore condition, and has a cutting success rate of 77%. The RCT does not contain explosives; this greatly reduces transportation costs and logistical problems.

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates to a method for recovering a tubular structure, such as a drill pipe string, from a well, such as a highly deviated or horizontal well. A so-called free point is defined as the location where the tubular structure is stuck in the well. A free pipe is defined as a part of the tubular structure, which is downstream of the free point. A stuck pipe is defined as another part of the tubular structure, which is upstream of the free point. The method comprises steps of:

- providing a downhole tool comprising a pipe severing tool and an upper part of the downhole tool;
- lowering the downhole tool into the tubular structure to such a depth that the pipe severing tool is at the free point of the tubular structure, and
- triggering the pipe severing tool to severe said tubular structure to release the free pipe.

Before the step of triggering the pipe severing tool to severe said tubular structure, the method comprises steps of releasing the pipe severing tool and subsequent withdrawing the upper part of the downhole tool away from the free point towards the surface over at least a predefined distance.

The effects of the combination of the features of the invention are as follows. The inventor has realized that, particularly in highly deviated or horizontal wells, the pipe severing tools are destructive not only for the tubular structure (which is of course intended), but also harmful or even destructive for the downhole equipment including expensive specialised conveyance tools required to deploy the pipe-severing tool (which is undesired). The shock waves that are produced may be so large that they also damage the downhole tools. Similar problems occur when other severing techniques are used. The inventor has realized that there is actually a need to modify the existing method of severing tubular structures. It must be understood that the downhole equipment itself also needs some modifications, which will be discussed in view of a further aspect of the invention. Nevertheless, in the basis the invention resides in modifying the known method of recovering a tubular structure by introducing extra steps in the method just before the tubular structure is severed by the pipe-severing tool.

In a first additional step the pipe-severing tool is brought into the tubular structure (i.e. a drill string) at the predetermined depth (cut point) and subsequently disconnected from the remainder of the downhole tool string.

Subsequently in a second additional step the remainder of the downhole tool string is brought to a "safe distance" from the (shock wave to be created by the) pipe-severing tool, before the severing step is triggered, i.e. an explosion is triggered (i.e. via a timer) to severe the tubular structure. A shockwave from the explosion (or chemicals) from the severing tool will then no longer harm the remainder of the downhole tool string, which was released before the pipe-severing operation and moved up hole. This prevents the remainder of the downhole equipment from being damaged. Another advantage of the invention is that higher amounts of explosives or chemicals can be used for better severing of the tubular structure without damaging the main components in the downhole tool string.

For the triggering of the severing step many different options are available. For instance, a timer can be set to go off after a certain amount of time or at a specific instant in time, wherein this time must be set to be enough to release the severing tool and bring the remainder of the downhole tool string (also referred to as the upper part of the downhole tool string) at a safe distance. Alternatively, an electrical or optical wire connection is maintained between said separated parts, such that the triggering can be done remotely by the remainder of the downhole tool string. In yet a further alternative embodiment a wireless connection is used between the remainder of the downhole tool string and the severing tool, or between the severing tool and the surface equipment.

It must also be stressed that step of triggering the pipe-severing tool to severe may include multiple sub-steps, wherein in a first sub-step the tubular structure is weakened or loosened and in a second sub-step the severing or cutting of the tubular structure is completed. For example first, in a first sub-step, the tubular structure is locally weakened at a respective joint that is nearest to the free point, for instance by means of an explosion, where after, in a second sub-step, the tubular structure is unscrewed at the same joint using the surface equipment. The invention is applicable as long as there is at least one sub-step, which is harmful or destructive to the downhole equipment. If the step of triggering comprises multiple sub-steps then it is important that the remainder of the downhole tool string is withdrawn at least before the sub-step that is harmful or destructive to the downhole equipment.

An embodiment of the method in accordance with the invention further comprises, before the step of releasing the pipe-severing tool, a step of anchoring said pipe severing tool at the pre-set depth in the tubular structure. This embodiment ensures that the pipe-severing tool is firmly secured during the severing step.

An embodiment of the method in accordance with the invention further comprises, after the step of triggering the pipe severing tool to severe said tubular structure, steps of:

- lowering the upper part of the downhole tool to the pipe-severing tool;
- coupling the upper part of the downhole tool to the pipe-severing tool, and
- lifting the downhole tool to the surface.

This embodiment advantageously recovers the pipe-severing tool after the severing step.

An embodiment of the method in accordance with the invention further comprises the step of removing the free pipe from the well. This embodiment of the method further completes the recovering of the tubular structure (i.e. stuck drill pipe string) from the well.

In an embodiment of the method in accordance with the invention, in the step of providing the downhole tool, the pipe-severing tool comprises a pipe-severing unit selected from a group comprising: a chemical cutter tool, a jet cutter tool, a radial cutting torch, a drill collar-severing tool and a string-shot back-off tool. The cutter tools and the back-off tool, which are listed here form known tools from the prior art. The inventor has realized that all pipe-severing tools may have a harmful effect on the downhole equipment. The invention may thus be advantageously applied in combination with any of these tools.

String-Shot back-off cutting works as follows. Once the free point of a stuck pipe string is determined, the string-shot back-off service can be used to remove the free portion from the well. The string-shot back-off procedure applies left-hand torque to the stuck pipe string. The string-shot is then positioned at the predetermined pipe joint and detonated. The explosion produces a similar effect as an intense hammer blow and allows the joint to be unscrewed at the proper connection.

In an embodiment of the method in accordance with the invention, in the step of providing the downhole tool, the downhole tool further provides a wireline tractor in the upper part. A wireline tractor is advantageously used when the well is highly deviated or horizontal. The wireline tractor will typically form part of the upper part of the downhole tool string often together with a correlation tool, and will therefore be protected by the invention as well.

In an embodiment of the method in accordance with the invention the tubular structure comprises a drill pipe string. The invention is particularly useful where the tubular structure comprises a drill pipe string. In this application field string-shot back-off tools are most often used to separate drill pipe segments which are stuck.

In an embodiment of the method in accordance with the invention the well comprises a highly deviated or horizontal well bore. The invention is particularly useful when the well comprises a deviated or horizontal well bore, because in such wells conveyor tools like wireline tractors are typically needed to bring the downhole tool string at the desired location for separating the tubular structure or pipe string.

In a second aspect the invention relates to a downhole tool string for use in the method in accordance with the invention. The embodiment relates to any downhole tool string, which comprises a (drill) pipe-severing tool and is adapted such that it allows the method of the invention to be carried out. The embodiments discussed hereinafter specify possible features in such downhole tools including their advantageous effects.

In an embodiment of the downhole tool string in accordance with the invention the upper part of the downhole tool string comprises a release tool for releasably coupling with the (drill) pipe-severing tool. A release tool is a downhole tool, which enables the coupling and decoupling between two different sections of downhole tool string. Such tool may be advantageously used in the current invention.

In an embodiment of the downhole tool string in accordance with the invention the pipe-severing tool comprises an anchor tool connected in series with a pipe-severing unit. This embodiment ensures that the pipe-severing tool is firmly secured during the severing step.

In an embodiment of the downhole tool string in accordance with the invention the pipe-severing unit is selected from a group comprising: a chemical cutter tool, a jet cutter tool, a radial cutting torch, a drill collar-severing tool, and a string-shot back-off tool. The cutter tools and the back-off tool, which are listed here form known tools from the prior art. The inventor has realized that all pipe-severing tools may have a harmful effect on the downhole equipment. The invention may thus be advantageously applied in combination with any of these tools.

In an embodiment of the downhole tool string in accordance with the invention the upper part of the downhole tool string further provides a wireline tractor. The wireline tractor will typically form part of the upper part of the downhole tool string often together with a correlation tool, and will therefore be protected by the invention as well.

In the following is described an example of a preferred embodiment illustrated in the accompanying drawings, wherein:

FIG. 1 shows an embodiment of the downhole tool string in accordance with the invention, and FIGS. 2 to 7 show different stages of an embodiment of the method in accordance with the invention.

It should be noted that the above-mentioned and below-discussed embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

FIG. 1 shows an embodiment of the downhole tool string 100 in accordance with the invention. This embodiment uses a drill collar-severing tool, but the invention is not limited to such severing tool. The invention is applicable to any kind of cutter or severing tool, which is harmful towards downhole equipment. The downhole tool string 100 comprises a pipe-severing tool 5 (or tool string) connected to an upper part 7 of the downhole tool string 100. The pipe-severing tool 5 comprises a pipe-severing unit 10 and an anchor tool 20 connected to it. The anchor tool 20 is further connected on its on end to a firing head tool 30. The upper part 7 of the downhole tool string 100 comprises a string comprising a release tool 40, a depth correlation tool 50 (or position tool), a wireline tractor 60, a swivel 70, and a cable head 80 as illustrated in FIG. 1. The release tool 40 is coupled to the firing head tool 30 of the pipe severing tool string 5. The cable head 80 is coupled to a wireline cable (not shown) that runs to the surface.

The release tool 40 is a tool, which facilitates releasing of a part of a tool string that is connected to it. In an embodiment it is the release tool 40, which separates in two parts, one part remaining in connection with the wireline and one part staying behind. In an alternative embodiment the release tool 40 is designed for holding and releasing another tool. In yet another embodiment the release tool 40 maintains a wired connection between the separated parts (electrical or optical) for communication and/or power transport. All such variants may be advantageously used in the invention.

It must be further noted that the embodiment of FIG. 1 is just an example. The tool string 100 may comprises fewer or more components. What is important in the invention is that there is a pipe-severing tool (string) 5 and that there is the feature of releasing said severing tool (string) 5 from the remainder (or upper part) of the tool string 7, while the remainder of the tool string 7 is lifted up away from the cutting area. The recovery of the pipe-severing tool (string) 5 may be done right after the cutting operation or at a (much) later stage.

FIGS. 2 to 7 show different stages of an embodiment of the method in accordance with the invention. It must be noted that the ratio between the horizontal and vertical scaling in FIGS. 2 to 7 deviates a bit from that of FIG. 1, which has been done for illustration purposes only. Moreover, neither one of the figures has been drawn to scale. FIG. 2 shows a first stage of the method. In this stage a downhole tool string 100 as illustrated in FIG. 1 is provided and lowered into a well bore 1 via a cable 90.

FIG. 2 further shows a tubular structure 3 (here a drill pipe string) which is stuck at a well bore obstacle or deviation 2 as shown. The problem is particularly present in highly deviated or horizontal wells, where typically a tractor is needed to bring the equipment down. This deviation 2 defines the so-called free point 4 as discussed earlier in this description. The main goal of the drill pipe string recovery operation is to cut or split the tubular structure 3 as close as possible to the free point 4. Therefore, the downhole tool string 100 is lowered in the well bore 1 to such a depth that the pipe-severing unit 10 is very close to the free point 4.

Figure 1:
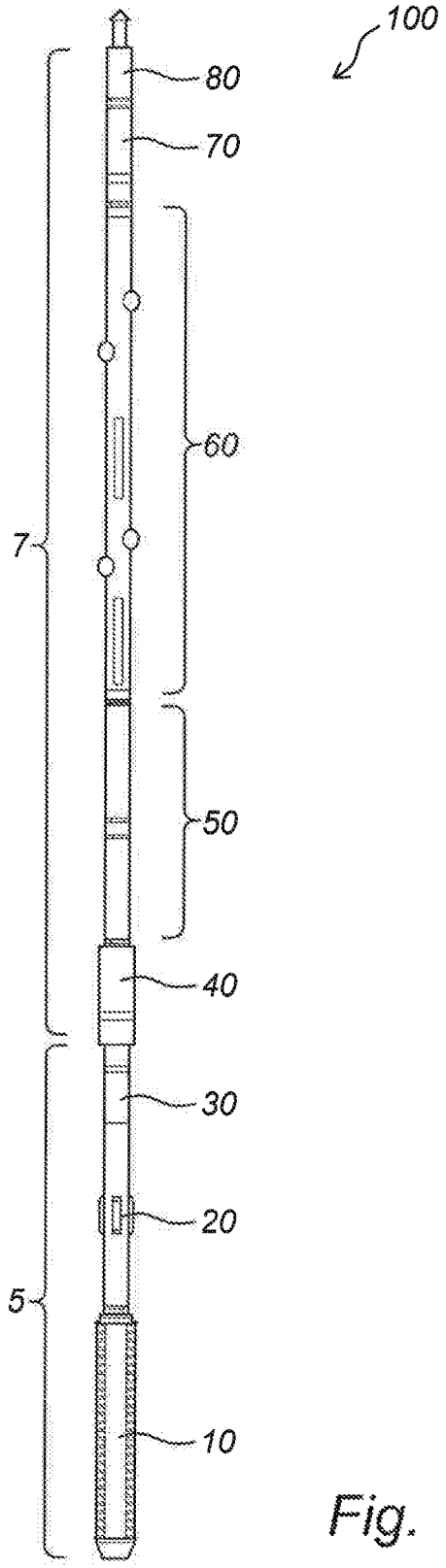
Figure 2:
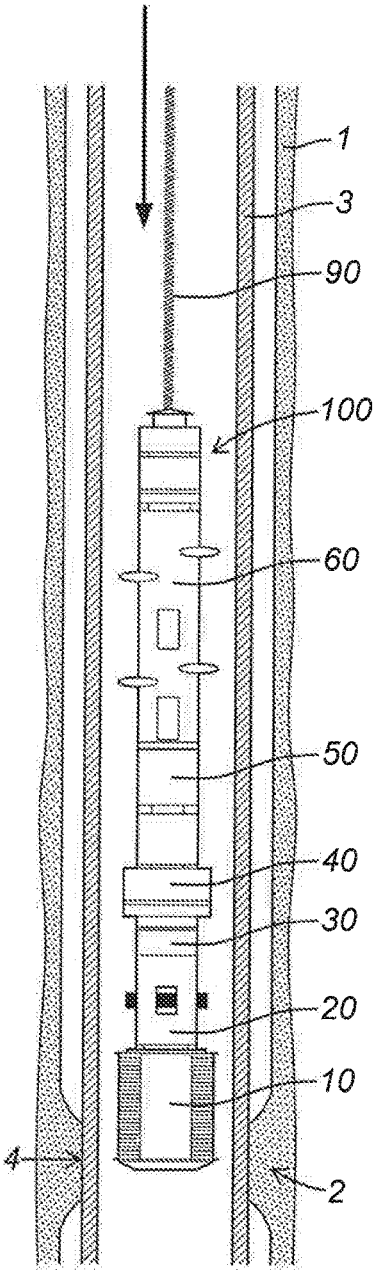
Figure 3:
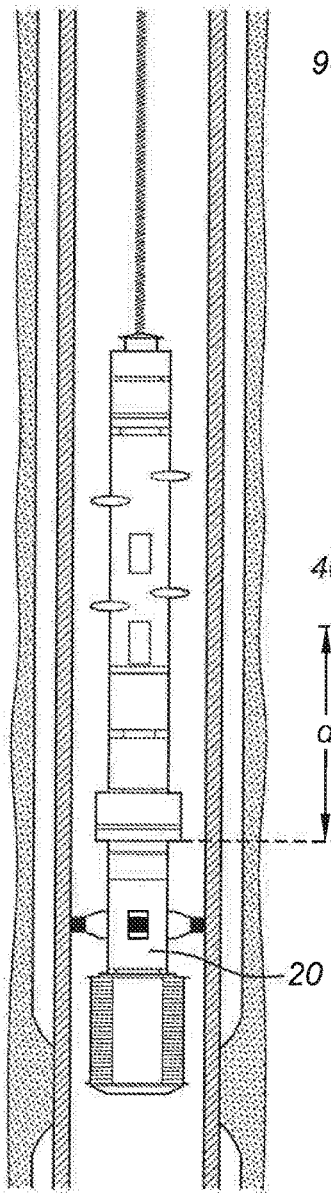
FIG. 3 shows a further stage of the method, wherein the anchor tool 20 has been triggered to lock the position of the pipe-severing unit 10.
Figure 4:
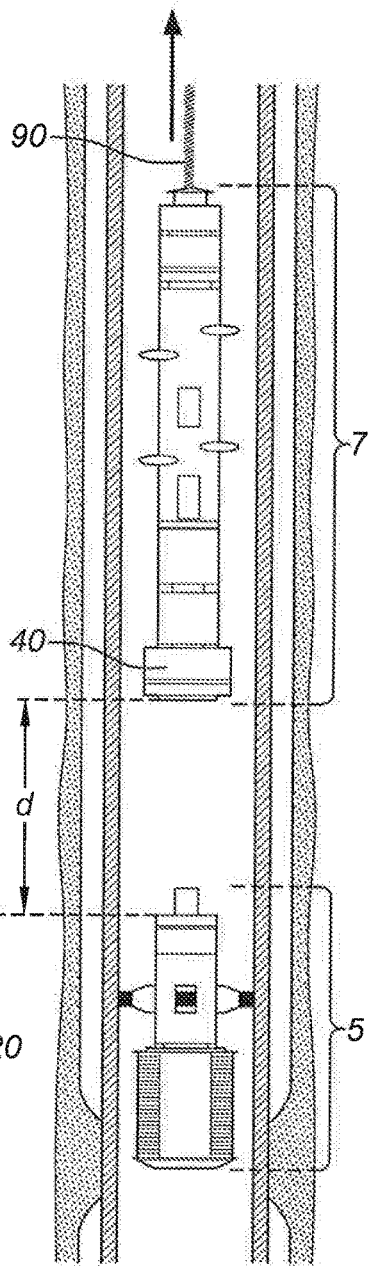
FIG. 4 shows a further stage of the method, wherein the release tool 40 has been triggered to release the lower part (pipe-severing tool) 5 of the tool string connected to it and subsequently the upper part 7 of the tool string has been withdrawn over a predefined distance d.
Figure 5:
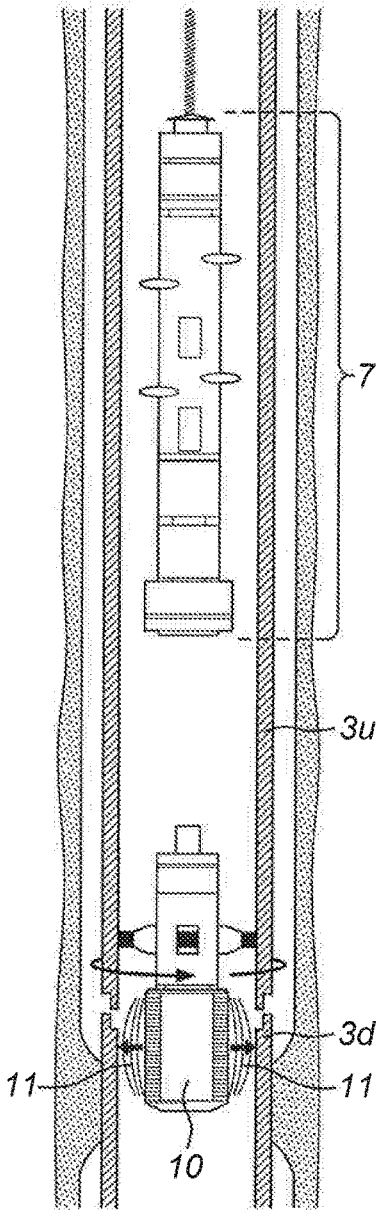

FIG. 5 shows a further stage of the method, wherein the pipe-severing unit 10 has been triggered to severe the tubular structure 3 by means of an explosion 11 (but other ways exists also, such as chemicals, jet or torch). The explosion 11 will consequently severe the tubular structure 3 and create a lower part **3*d* (referred to as stuck pipe) and an upper part 3*u*** (referred to as free pipe).

Figure 6:
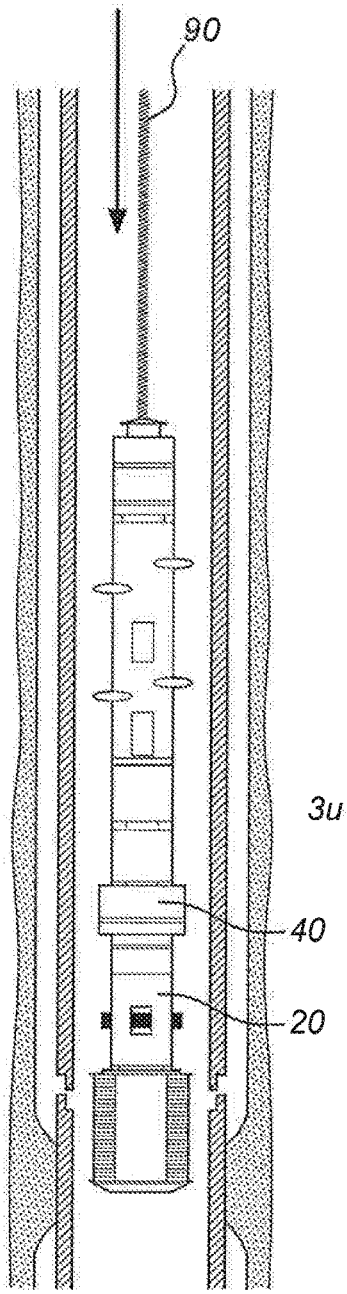

FIG. 6 shows a further stage of the method, wherein the upper part or remainder 7 of the downhole tool string 100 has been lowered again, and the release tool 40 has reengaged with the lower part of the tool. The anchor tool 20 has released its anchor.

Figure 7:
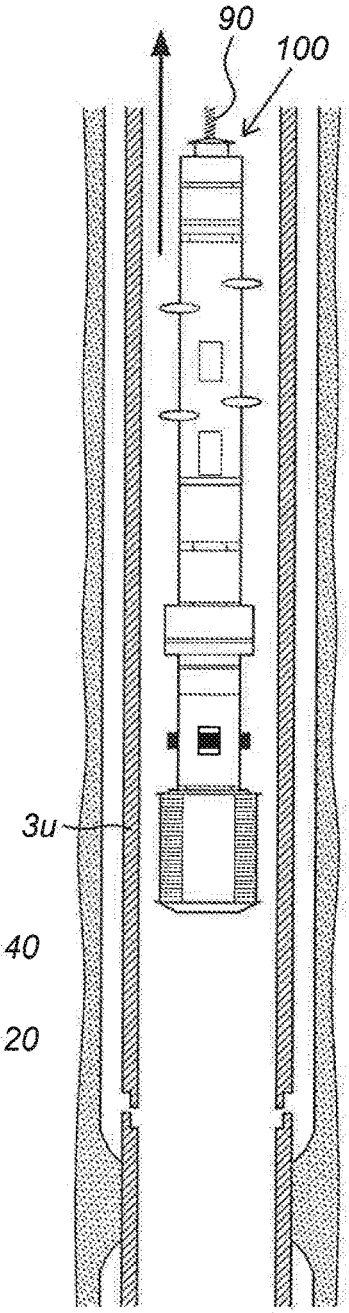

FIG. 7 shows a further stage of the method, wherein the downhole tool string 100 is pulled up to the surface via the cable 90. The free pipe **3*u* may be retrieved in the same run (for instance by retriggering the anchor tool 20**) or in a separate run using conventional techniques.

The invention provides for a method of recovering a tubular structure from a well bore, wherein the downhole equipment is protected from harm by the pipe severing operation through at least partial withdrawal of the equipment before triggering the severing operation. In order to make such method possible the downhole equipment must be adapted so that it can release the severing unit and reconnect to it at a later stage. The invention is particularly useful in a method of recovering a stuck drill pipe from a well bore in highly deviated or horizontal wells, where typically conveyor tools like wireline tractors are used to bring the equipment at the desired location.

The invention claimed is:

1. Method for recovering a tubular structure (3) from a well (1), wherein a free point (4) is defined as a location (2) where the tubular structure (3) got stuck in the well (1), wherein a free pipe is defined as a part (**3*u*) of the tubular structure (3) which is downstream of the free point (4), and wherein a stuck pipe is defined as another part (3*d*) of the tubular structure (3) which is upstream of the free point (4**), the method comprising steps of:

providing a downhole tool string (100) comprising a pipe-severing tool (5) and an upper part (7) of the downhole tool string (100);

lowering the downhole tool string (100) into the tubular structure (3) to a depth that the pipe-severing tool (5) is at the free point (4) of the tubular structure (3), and triggering the pipe-severing tool (5) to sever said tubular structure (3) to release the free pipe (3*u*), before the step of triggering the pipe-severing tool (5) to sever said tubular structure (3), releasing the pipe-severing tool (5) and subsequently withdrawing the upper part (7) of the downhole tool string (100) away from the free point (4) towards a surface over at least a predefined distance (d).

2. The method according to claim 1, further comprising, before releasing the pipe-severing tool (5), anchoring said pipe-severing tool (5) in the tubular structure (3).

3. The method according to claim 1, further comprising, after triggering the pipe-severing tool (5) to sever said tubular structure (3), steps of:

lowering the upper part (7) of the downhole tool string (100) to the pipe severing tool;

coupling the upper part (7) of the downhole tool string (100) to the pipe severing tool, and lifting the downhole tool string (100) to a surface.

4. The method according to claim 1, further comprising removing the free pipe (3*u*) from the well (1).

5. The method according to claim 1, wherein, in the step of providing the downhole tool string (100), the pipe-severing tool (5) comprises a pipe-severing unit (10) selected from a group consisting of: a chemical cutter tool, a jet cutter tool, a radial cutting torch, a drill collar-severing tool, and a string-shot back-off tool.

6. The method according to claim 1, wherein, in the step of providing the downhole tool string (100), the downhole tool string (100) further provides a wireline tractor (60) in the upper part (7) for conveying the downhole tool string (100) to a depth in the well (1).

7. The method according to claim 1, wherein the tubular structure (3) comprises a drill pipe string.

8. The method according to claim 1, wherein the well (1) comprises a highly deviated or horizontal well bore.

* * * * *